US008955442B1

(12) United States Patent
Fiala et al.

(10) Patent No.: US 8,955,442 B1
(45) Date of Patent: Feb. 17, 2015

(54) FLAMELESS SMOKE POT

(71) Applicant: U.S. Army Edgewood Chemical Biological Center, APG, MD (US)

(72) Inventors: John P. Fiala, Forest Hill, MD (US); Joseph A. Domanico, Bel Air, MD (US); Joseph E. May, Jr., Joppa, MD (US)

(73) Assignee: The United States of America As Represented by the Secretary of the Army, Washington, DC (US)

( * ) Notice: Subject to any disclaimer, the term of this patent is extended or adjusted under 35 U.S.C. 154(b) by 0 days.

(21) Appl. No.: 14/325,686

(22) Filed: Jul. 8, 2014

Related U.S. Application Data

(62) Division of application No. 13/799,514, filed on Mar. 13, 2013, now Pat. No. 8,776,692.

(51) Int. Cl.
*F42B 12/48* (2006.01)
*C06D 3/00* (2006.01)

(52) U.S. Cl.
CPC .. *C06D 3/00* (2013.01); *F42B 12/48* (2013.01)
USPC ..... 102/334

(58) Field of Classification Search
CPC ..... F42B 12/48; C06D 3/00
USPC ..... 102/334, 335, 336, 341, 358, 364, 367, 102/368, 369, 370, 482, 487
See application file for complete search history.

(56) References Cited

U.S. PATENT DOCUMENTS

| | | | | |
|---|---|---|---|---|
| 2,119,697 | A * | 6/1938 | Anderson | 102/341 |
| 3,110,259 | A * | 11/1963 | Van Dersarl | 102/341 |
| 4,291,629 | A * | 9/1981 | Kezer | 102/334 |
| 5,992,327 | A * | 11/1999 | Wardecki et al. | 102/334 |
| 6,666,143 | B1 * | 12/2003 | Collins | 102/334 |
| 8,776,692 | B1 * | 7/2014 | Fiala et al. | 102/334 |

* cited by examiner

*Primary Examiner* — James S Bergin
(74) *Attorney, Agent, or Firm* — Ulysses John Biffoni

(57) ABSTRACT

A flameless smoke pot and a method of generating smoke using the smoke pot. The smoke pot includes a casing having a side wall with an inlet openings and containing a plurality of perforated tubes containing red phosphorous pellets. A heat generating pyrotechnic composition is disposed at a first end of the casing to generate heat which flows through the perforated tubes containing red phosphorous pellets to produce white phosphoric acid clouds of smoke. The white phosphoric acid clouds of smoke are combined with atmospheric an containing water to generate the white phosphoric acid clouds of aerosol smoke. The white phosphoric acid clouds of aerosol smoke are directed through a perforated flame arrester whereby visible flame is prevented from being created.

9 Claims, 3 Drawing Sheets

FLAMELESS SMOKE POT

CROSS-REFERENCE TO RELATED APPLICATIONS

This application is a divisional of application Ser. No. 13/799,514 filed on Mar. 13, 2013, now U.S. Pat. No. 8,776,692 which is commonly assigned.

GOVERNMENT INTEREST

The invention described herein may be manufactured, used and licensed by or for the United States Government.

TECHNICAL FIELD OF THE INVENTION

The present invention relates generally to smoke pots, and, more particularly, to a flameless smoke pot and method of operating the flameless smoke pot.

BACKGROUND OF THE INVENTION

Smoke pots are typically used as ground-to-ground or ground-to-air signaling devices, target or landing zone marking devices, or as screening devices for military unit movements. Prior art and experimentation teach that obscuration efficiency is a function of particulate size, refractive index and concentration in the atmosphere. Conventional pyrotechnic obscurant compositions are, therefore, based on materials which generate a dense primary particulate, such as inorganic oxides, or compounds which easily form atmospheric aerosols, such as hydrochloric acid, polyphosphates, or phosphoric acid.

Chemicals in the category of screening smokes are those which, when dispersed in air, produce a cloud of finely divided particles of solid, liquid, or both, These are used to shield tactical operations or disrupt the movements of the enemy. Outstanding examples of such materials are: fuel oil used in "artificial fog" generators, white phosphorus, sulfur trioxide, titanium tetrachloride, and so called zinc chloride smokes. Each of the above-listed smoke-generating compositions is characterized by certain advantages and disadvantages in military operations, depending upon the importance of such factors as mobility of the smoke producing apparatus, toxicity, logistical considerations, and the total obscuring power of the composition employed.

SUMMARY OF THE INVENTION

According to the present invention, there is disclosed a flameless smoke pot. The smoke pot includes a casing having a side wall with air inlet openings containing a plurality of perforated tubes containing red phosphorous pellets. A heat generating pyrotechnic composition is disposed at a first end of the casing. A perforated flame arrester disposed above a second end of the casing. An igniting device is arranged in contact with the heat generating pyrotechnic composition.

According to the present invention, there is disclosed a homeless smoke pot including an elongated cylinder having an inlet opening at a first end, an outlet opening at a second end and a side wall with air inlet openings. A plurality of perforated tubes containing red phosphorous pellets disposed within the elongated container. A heat generating pyrotechnic composition is disposed within a container having an outlet opening mounted below the inlet opening at the first end of the elongated container. A perforated flame arrester having an open first end and a closed second end wherein the open first end is disposed above the second end of the elongated container.

Still further according to the present invention, a method of generating aerosol smoke with a homeless smoke pot is disclosed. Heat and oxygen generated with a heat generating pyrotechnic composition are directed through one or more perforated tubes containing red phosphorous pellets to produce white phosphoric acid clouds of smoke. The white phosphoric acid clouds of smoke are combined with atmospheric air and water to generate the white phosphoric acid clouds of aerosol smoke. The white phosphoric acid clouds of aerosol smoke are directed through a perforated flame arrester whereby visible flame is prevented from being created.

BRIEF DESCRIPTION OF THE DRAWINGS

The structure, operation, and advantages of the present invention will become further apparent upon consideration of the following description taken in conjunction with the accompanying figures (FIGS.). The figures are intended to be illustrative, not limiting. Certain elements in some of the figures may he omitted, or illustrated not-to-scale, for illustrative clarity. The cross-sectional views may be in the form of "slices", or "near-sighted" cross-sectional views omitting certain background lines which would otherwise be visible in a "true" cross-sectional view, for illustrative clarity.

In the drawings accompanying the description that follows, both reference numerals and legends (labels, text descriptions) may he used to identify elements. If legends are provided, they are intended merely as an aid to the reader, and should not in any way be interpreted as limiting.

DETAILED DESCRIPTION OF THE PREFERRED EMBODIMENTS

Figure 1:
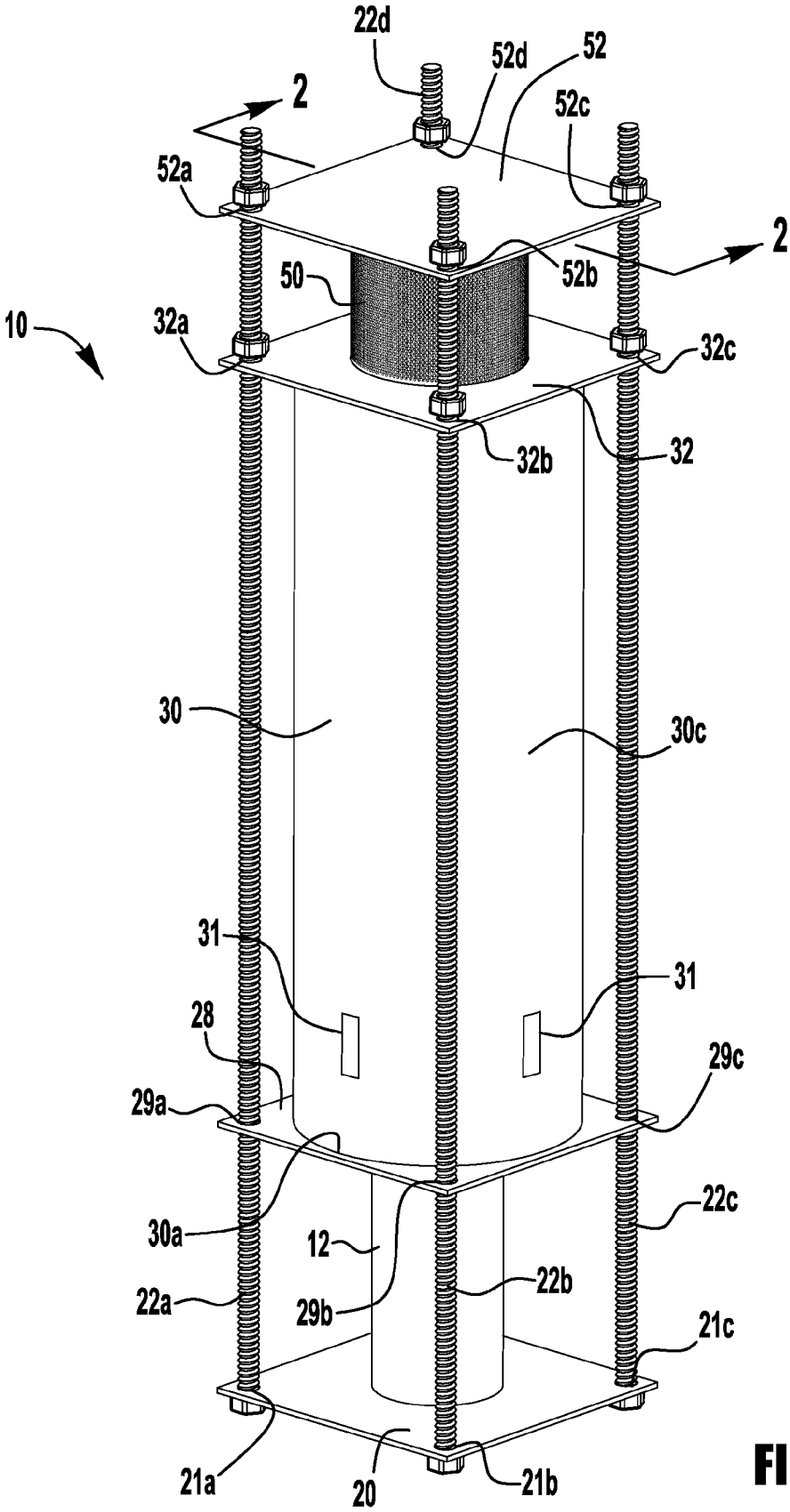
FIG. 1 is a front three dimensional view of the flameless smoke pot, in accordance with the present invention.

In the description that follows, numerous details are set forth in order to provide a thorough understanding of the present invention. It will be appreciated by those skilled in the art that variations of these specific details are possible while still achieving the results of the present invention. Well-known processing steps are generally not described in detail in order to avoid unnecessarily obfuscating the description of the present invention.

In the description that follows, exemplary dimensions may be presented for an illustrative embodiment of the invention. The dimensions should not be interpreted as limiting. The are included to provide a sense of proportion. Generally speaking, it is the relationship between various elements, where they are located, their contrasting compositions, and sometimes their relative sizes that is of significance.

In the drawings accompanying the description that follows, often both reference numerals and legends (labels, text descriptions) will be used to identify elements. If legends are provided, they are intended merely as an aid to the reader, and should not in any way be interpreted as limiting.

FIG. 1. illustrates a front, three-dimensional view of a flameless smoke pot 10, designed to utilize red phosphorus compositions to produce an aerosol smoke with substantially no visible flame. Prior to the flameless smoke pot 10, the use of red phosphorus in combined composition smoke pots resulted in smoke and yellow flame which identified the smoke pot location to the enemy and was therefore a safety hazard for the operators of the smoke pots.

Figure 2:
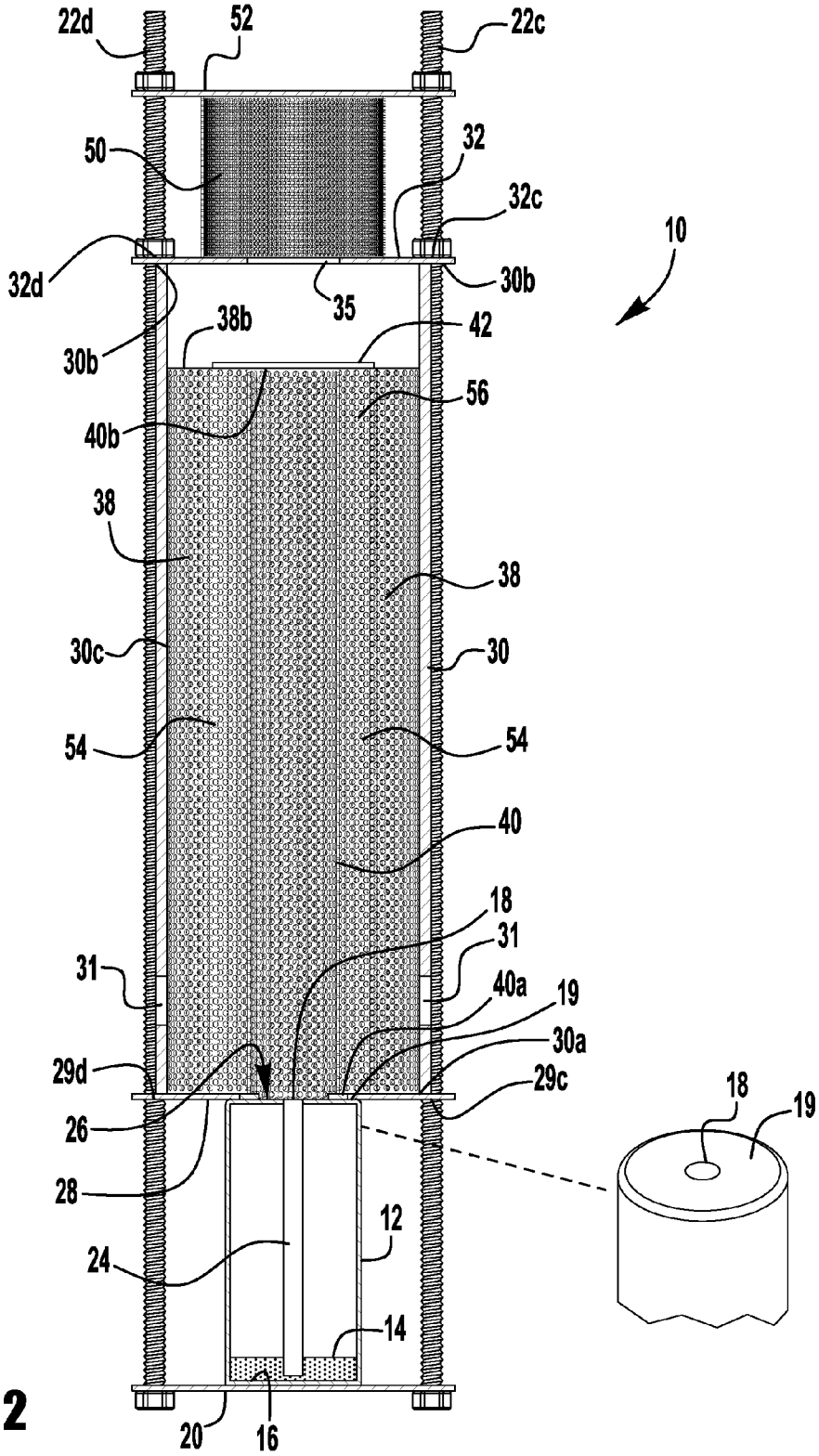
FIG. 2 is a view through Line 2-2 of FIG. 1, in accordance with the present invention.

The present embodiment, as shown in FIG. 1, provides a flameless smoke pot 10 wherein the physical combination of independent chemical compositions, when reacted, will produce a dense, aerosol smoke particularly adapted for military purposes, such as for signaling or for camouflage. The configuration of the smoke pot 10 separates the red phosphorus smoke material 54 from the. heat and oxygen pyrotechnic composition 14, as seen in FIG. 2. It is therefore a general object of the flameless smoke pot to place the red phosphorus apart from the heat generating pyrotechnic composition 14, as described below.

In operation, the chemical reaction of the red phosphorous smoke material and the heat generating pyrotechnic composition is as follows: Red phosphorus smoke material (54) reacts with oxygen and water to produce "smoke."

$4\ P\ (red)+heat \rightarrow P_4\ (gas)$ $P_4\ (gas)+5\ O_2 \rightarrow 2\ P_2O_5\ (solid)+heat$ As indicated directly below, the resulting phosphorus pentoxide ($P_2O_5$) is highly hygroscopic and attracts enough water to produce dense white phosphoric acid clouds.

$P_2O_5+3\ H_2O \rightarrow 2\ H_3\ PO_4+heat$

The hygroscopic phosphorus acid vapor $P_2O_5$ adds water from the atmosphere to produce, a dense white cloud of an aerosol smoke.

The present invention relates to a smoke-producing device 10 which produces a flame that is barely visible. The difficulties in promoting the reactions without flaming are: 1) achieving a reaction rate that produces acceptable smoke generation; and 2) achieving complete phosphorus conversion. If the red phosphorus and the oxidizer with fuel are not mixed together, they can be located so as to optimize the arrangements for their interactions. The low flame concept of the present embodiment is achieved by physically separating the smoke material (the red phosphorus pellets 54) and the heat source material (the heat generating, pyrotechnic composition 14). The heat source material must supply the smoke material with just the amount of energy needed for generating the smoke. If more energy were provided, flaming of the red phosphorus would result as with the currently used phosphorus compositions that produce a yellow flame which identifies the location of the smoke pot location, such as to the enemy and is therefore a safety hazard for those using the prior art smoke pot.

As seen in FIGS. 1 and 2, the smoke pot 10 includes an enclosed container 12 having a heat and oxygen pyrotechnic composition 14 on the enclosed bottom end 16 and an opening 18 through the cover 19 of container 12. Container 12 abuts and is secured to first support plate 28 by any means such as fair example welding or the container 12 can be secured to a bottom base 20 by any means such as welding. The bottom plate 20 can secure the container 12 between the first support plate 28 and the bottom base 20. For exemplary purposes only, four holes, 21*a*, 21*b*, 21*c*, and 21*d* (not shown) (21*a*-21*d*) in each corner of bottom base plate 20 can accommodate support pins 22*a*, 22*b*, 22*c*, and 22*d* that stabilize the smokeless pot 10, as discussed in more detail herein. The heat and oxygen pyrotechnic composition 14 is ignited with an igniting device 24, as described below. After the heat and oxygen pyrotechnic composition 14 has been ignited, the hot gas created escapes through an opening 18 through the cover 19 of the container 12 and then flows into an opening 26 through a first support plate 28 having four holes, 29*a*, 29*b*, 29*c*, and 29*d* (29*a*-29*d*) in each corner, The first support plate 28 has substantially the same dimensions as bottom base plate 20 and is disposed above the bottom base plate so that the tour holes 29*a*-29*d* overlie the four holes 21*a*-21*d*.

The open bottom end 30*a* of a casing or container 30, such as an elongated cylinder, is secured at end 30*a* by any means such as welding to the support plate 28. The elongated cylinder 30 is positioned so that it is centered atop the opening 26 through the support plate 28. The elongated cylinder 30 has air inlets 31 disposed therethrough in its side wall 30*c*. Support plate 28 and four holes 29*a*-29*d* corresponds to the shape and location of holes 21*a*-21*d* in bottom base plate 20. As seen in FIGS. 1 and 2, the elongated cylinder 30 is secured at an open top end 30*b* by any means such as welding to a second support plate 32 having four holes, 32*a*, 32*b*, 32*c*, and 32*d* (32*a*-32*d*) in each corner and an opening 35, as seen in FIG. 2 therethrough. Support plate 32 and four holes 32*a*-32*d* corresponds to the shape and location of holes 21*a*-21*d* in bottom base plate 20 and is disposed above the bottom base plate 20 and the first support plate 28 so that the four holes 32*a*-32*d* overlie the four holes 29*a*-29*d* in plate 28 and the four holes 21*a*-21*d* in plate 20.

Figure 4:
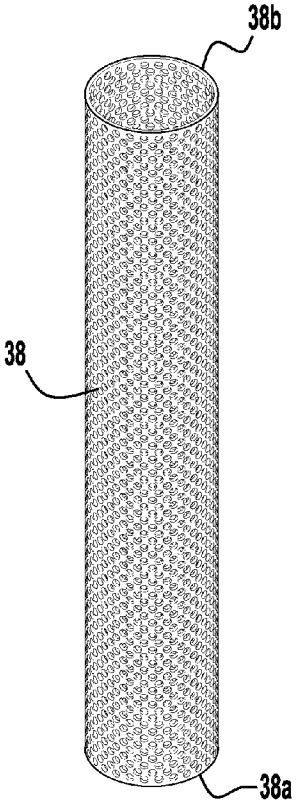
FIG. 4 is a three dimensional view of the perforated tube, in accordance with the present invention.
Figure 3:
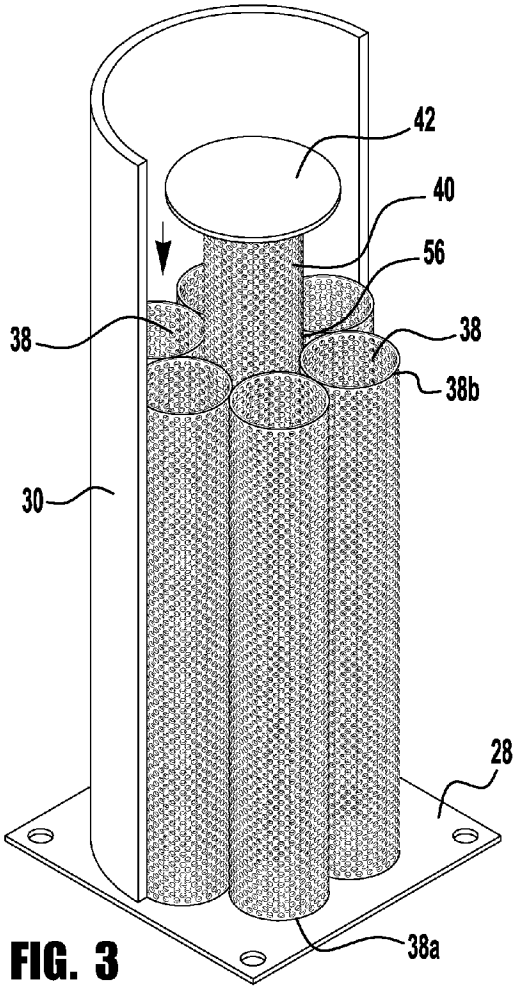
FIG. 3 is a cross-sectional, three dimensional view of the elongated casing of the flameless smoke pot, in accordance with the present invention.

As shown in FIG. 3, six substantially identical, perforated or woven wire, containers such as perforated tubes 38, of the type shown in FIG. 4, are disposed in elongated cylinder 30 with their bottom ends 38*a* supported by the upper surface of support plate 28. The 6 perforated tubes 38 can be arranged in a circular configuration, as shown in FIG. 3, to form an opening 56 therebetween. The perforated or woven wire tubes 38 may be of any appropriate dimensions and shapes. The perforated or woven wire tubes 38 may be constructed of any suitable material, though typically metal including steel. While six (6) perforated tubes 38 are shown, it is within the scope of the invention to use more or less tubes within the cylinder 30.

Figure 5:
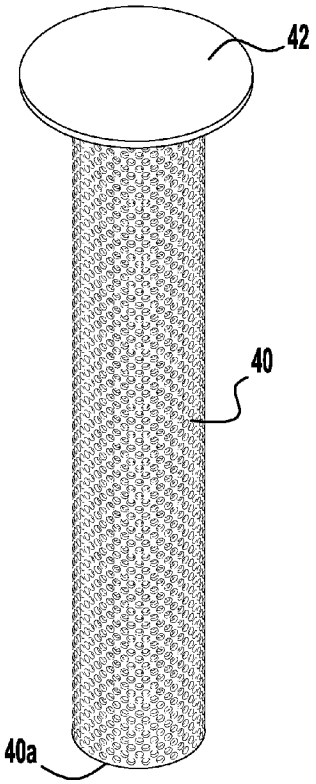
FIG. 5 is a three dimensional view of the central perforated tube, in accordance with the present invention.

A central perforated or woven wire container, such as a tube 40, as shown in FIG. 5, is inserted in the space 56 between the facing surfaces of tubes 38 as shown in FIG. 3, The perforated or woven wire tube 40 may be of any appropriate dimensions and shapes and may be constructed of any suitable material, though typically metal including steel. A solid partition, such as a disc 42, is affixed to the upper end 40*b* of central tube 40 by any means such as welding, as shown in FIGS. 3 and 5. The diameter of solid disc 42 is greater than tube 40 so that the solid disc rests on the upper ends 38*b* of tubes 38. In this way, the central tube 40 is supported between the six tubes 38. The outer diameter of central perforated tube 40 can be selected to press the tubes 38 against each of the cylinders 30 as shown in FIGS. 2 and 3. When the central perforated tube 40 is in position as shown in FIG. 2, the lower end 40*a* rests against plate 28 so that the central tube is centered over the opening 26 whereby hot gases flow from container 12, through opening 18, through opening 26 in support plate 28 and then into central perforated tube 40. Since solid disc 42 closes the upper end 40*b* of central perforated tube 40 so that the hot gases are forced out of the sides of central perforated tube 40 and into the surrounding perforated or woven wire tubes 38. While one (1) perforated tube 40 is shown, it is within the scope of the invention to use more or less tubes within the cylinder 30.

Atop second support plate 32 is a perforated metal flame arrester 50, which is typically a hollow, perforated metallic canister, such as cylindrically shaped canister of any suitable dimensions. The flame arrester 50 can be constructed of any casing material, such as for example steel. The perforated metal flame arrester 50 sits atop the third support plate 32 and is centered over the opening 35 in support plate 32 so as to cool the exiting gas flowing through the red phosphorous pellets provided in perforated cylinders 38 to below flame temperature as described in more detail hereinafter. The perforated metal flame arrester 50 is held in place by a solid, fourth support plate 52 having four holes 52*a*, 52*h*, 52*c*, and 52*d* (52*a*-52*d*) in each corner which corresponds to the shape and location of holes 21*a*-21*d* in bottom base plate 20, holes 29*a*-29*d* in first support plate 28, and holes 32*a*-32*d* in second support plate 32. When the smoke pot 10 is assembled with rods 22*a*-22*d*, the perforated metal flame arrester 50 is held in place between support plate 32 and sold support plate 52.

Located within each of the cylindrically shaped, perforated or woven wire tubes or containers 38 are red phosphorous pellets 54, preferably having a right circular cylindrical shape. However, it is within the terms of the preferred embodiment to use red phosphorous pellets of any desired shape. Note that although the pellets 38 "touch" each other, they are not pressed into the wire tubes or containers because there must be space between the cylindrical sides of adjacent pellets to allow smoke to exit. The phosphorous pellets 54 in perforated cylinders 38 are smoke generating and designed from red phosphorus powder and a binder permitting a right circular cylinder pellet shape, such as those from L8AI grenades. These red phosphorous pellets are nominally 0.25 inch in diameter by 0.25 inches long and can be made, for example, from red phosphorus and a 5% uncured butyl rubber binder.

In general, the perforated or woven wire tubes 38 are designed with a relatively small diameter to expose more of the surface of pellets 54 to the heat and oxygen generated by the heat and oxygen pyrotechnic composition 14. The greater the exposure of the surface of pellets 54 to the heat and oxygen generated, the greater the red phosphorus reaction rate and smoke formation.

As illustrated in FIGS. 2 and 3, the six perforated or woven wire tubes 38 are clustered in a circular group and form an elongated opening 56 therebetween. The perforated or woven wire central tube 40, as shown in FIG. 5, is inserted in opening 56 between the facing surfaces of tubes 38 as shown in FIG. 3. The solid disc 42, affixed to the upper end of tube 40, as shown in FIG. 2, is disposed against the end surfaces 38*a* of the as shown in FIG. 2, to support the perforated or woven wire tube 40.

In operation, the heat and oxygen pyrotechnic composition 14 in container 12 are ignited by a conventional igniting device 24. The generated heat and oxygen gas passes out of outlet opening 19 of container 12, through the opening 26 in support plate 28, through central perforated tube 40 and into the perforated or woven wire tubes 38 where it engulfs the red phosphorous pellets 54. Atmospheric air and water enters into the elongated cylinder 30, such as though air inlet openings 31 in the wall of elongated cylinder 30 as shown in FIGS. 1 and 2, to interact with the phosphorus pentoxide ($P_2O_5$) formed by heating the red phosphorous pellets 54. Being that the phosphorus pentoxide is highly hygroscopic, it attracts enough water from the atmospheric air to produce dense white phosphoric acid clouds of an aerosol smoke. This smoke is particularly adapted for military purposes, such as for signaling or for camouflage.

The white phosphoric acid clouds of an aerosol smoke exits from the opening 38*b* at the top of the tubes 38 and from spaces between tubes 38 and casing 30, flows through opening 35 in support plate 32 and into the perforated metal flame arrester 50, which is typically a hollow, cylindrical shaped perforated metallic canister. The resulting dense white phosphoric acid cloud flows through the sides of the flame arrester 50 and around the sides of the support plate 52. Being that the perforated metal flame arrester 50 sits atop the third support plate 32 and is centered over the opening 35 in support plate 32 any visible flame from the white phosphoric acid cloud is prevented from being created. This is because the exiting smoke, formed by the white phosphoric acid cloud, is cooled by the perforated metal flame arrester 50 to below flame temperature, That is, the flame arrester 50 functions by forcing a flame front created by heating the red phosphorous pellets 34 to flow through channels, i.e., the openings through the perforated or woven wire of the flame arrester 50, which are too narrow to permit the continuance of a flame.

By separating the red phosphorus pellets 54 from the heat generating pyrotechnic composition 14, the quantities and the reaction rates of the independent compositions can be optimized so that the resulting smoke is produced without or substantially without flame.

Although the invention has been shown and described with respect to a certain preferred embodiment or embodiments, certain equivalent alterations and modifications will occur to others skilled in the art upon the reading and understanding of this specification and the annexed drawings. In particular regard to the various functions performed by the above described components (assemblies, devices, etc.) the terms (including a reference to a "means") used to describe such components are intended to correspond, unless otherwise indicated, to any component which performs the specified function of the described component (i.e., that is functionally equivalent), even though not structurally equivalent to the disclosed structure which performs the function in the herein illustrated exemplary embodiments of the invention. In addition, while a particular feature of the invention may have been disclosed with respect to only one of several embodiments, such feature may be combined with one or more features of the other embodiments as may be desired and advantageous for any given or particular application.

We claim:

1. A method of generating aerosol smoke with a flameless smoke pot, comprising:

directing heat and oxygen generated by a heat generating pyrotechnic composition through one or more perforated tubes containing red phosphorous pellets to produce white phosphoric acid clouds of smoke;

combining the white phosphoric acid clouds of smoke with atmospheric air containing water to generate white phosphoric acid clouds of aerosol smoke; and directing the white phosphoric acid clouds of aerosol smoke through a perforated flame arrester whereby visible flame is prevented from being created.

2. The method of generating aerosol smoke with a timeless smoke pot of claim 1, including disposing the one or more perforated tubes containing red phosphorous pellets within a casing;

directing heat and oxygen generated by said heat generating pyrotechnic composition through a first end of the casing; and directing the white phosphoric acid clouds of aerosol smoke through the perforated flame arrester disposed above a second cud of the casing.

3. The method of generating aerosol smoke with a flameless smoke pot of claim 1, including igniting the heat and oxygen pyrotechnic composition with an igniting device.

4. The method of generating aerosol smoke with flameless smoke pot of claim 1, further comprising:

forming a casing of an elongated container; and disposing said plurality of perforated tubes within the elongated container.

5. The method of generating aerosol smoke with a flameless smoke pot of claim 4, including providing a central perforated tube between the plurality of perforated tubes; and directing the heat and oxygen gas generated by the heat generating pyrotechnic composition through the central perforated tube and into the plurality of perforated tubes.

6. The method of generating aerosol smoke with a flameless smoke pot of claim 5, including directing the atmospheric air containing water through air inlet openings in a sidewall of the elongated cylinder to combine with the white phosphoric acid clouds of smoke and generate the white phosphoric acid clouds of aerosol smoke.

7. The method of generating aerosol smoke with a flameless smoke pot of claim 6, including:

generating phosphorus pentoxide; and interacting the phosphorus pentoxide with atmospheric air containing water to form visible aerosol smoke.

8. The method of generating aerosol smoke with a dateless smoke pot of claim 7, including:

generating phosphorus pentoxide through the reaction of heat and air in the perforated tubes with the red phosphorus pellets; and attracting water from the atmospheric air to produce the white phosphoric acid clouds of aerosol smoke.

9. The method of generating aerosol smoke with a flameless smoke pot of claim 8, including:

providing the perforated flame arrester as a perforated metal tube having an open first end and a closed second end; and disposing the first open end of the perforated flame arrester above the second end of the casing whereby the aerosol smoke flows through the perforated metal tube cooling the aerosol smoke flowing through the perforated metal tube to below flame temperature.

* * * * *